United States Patent [19]

Kunczynski

[11] Patent Number: 4,462,314

[45] Date of Patent: Jul. 31, 1984

[54] ROCKER ARM ASSEMBLY FOR AN AERIAL TRAMWAY

[76] Inventor: Jan K. Kunczynski, 2400 Arrowhead Dr., Carson City, Nev. 89701

[21] Appl. No.: 346,167

[22] Filed: Feb. 5, 1982

[51] Int. Cl.[3] ..... B61B 7/00

[52] U.S. Cl. ..... 104/115; 104/125; 104/179; 104/197; 108/1; 182/1; 182/113; 200/61.08; 254/390; 474/92

[58] Field of Search ..... 104/112, 115, 116, 110, 104/93, 173 ST, 124, 125, 178, 179, 197; 200/61.08, 61.18; 254/390, 394, 134.3 PA; 474/92, 94, 165; 182/1, 113, 129, 222; 108/1

[56] References Cited

U.S. PATENT DOCUMENTS

| | | | |
|---|---|---|---|
| 646,665 | 4/1900 | Jameson | 182/1 |
| 655,923 | 8/1900 | Dutton | 182/1 |
| 2,203,113 | 6/1940 | Uecker et al. | 182/129 |
| 2,362,170 | 11/1944 | Swalsgood | 182/113 |
| 3,274,954 | 9/1966 | Doppelmayr | 104/115 |
| 3,822,369 | 7/1974 | Kunczynski | 200/61.08 |
| 4,019,002 | 4/1977 | Kunczynski | 104/178 |
| 4,179,994 | 12/1979 | Kunczynski | 104/173 ST |
| 4,220,095 | 9/1980 | Segafredo | 104/173 ST |
| 4,226,187 | 10/1980 | Paulsen et al. | 104/173 ST |
| 4,246,456 | 1/1981 | Leonard | 200/61.08 |

FOREIGN PATENT DOCUMENTS

| | | | |
|---|---|---|---|
| 817762 | 8/1951 | Fed. Rep. of Germany | 104/115 |
| 840850 | 4/1952 | Fed. Rep. of Germany | 104/115 |
| 2355294 | 11/1972 | Fed. Rep. of Germany | 104/179 |
| 2729703 | 1/1979 | Fed. Rep. of Germany | 474/166 |

*Primary Examiner*—David A. Scherbel
*Assistant Examiner*—Donald Hajec
*Attorney, Agent, or Firm*—Manfred M. Warren; Robert B. Chickering; Glen R. Grunewald

[57] ABSTRACT

A rocker arm assembly for support of the haul rope of an aerial tramway or the like is disclosed. The assembly includes rocker arms, rope supporting sheaves rotatably mounted to the rocker arms and cantilevered from an inwardly facing side of the rocker arms. The rocker arms are additionally formed with rope catching groove or recess positioned outwardly of the sheaves and having a configuration which will enable not only the rope, but a hanger arm and grip to pass over the rope catcher in the event that the haul rope derails from the sheaves. The rocker arm assembly also preferably includes a platform which acts as a mount for the rocker arms and can be used for maintainence and repair of the rocker arms and rope supporting sheaves. Additionally, the rocker arm assembly includes haul rope derailment responsive apparatus formed to shutdown the tramway operation upon derailment of the rope from the sheaves.

13 Claims, 12 Drawing Figures

ROCKER ARM ASSEMBLY FOR AN AERIAL TRAMWAY

BACKGROUND OF THE INVENTION

Aerial tramways are conventionally supported from towers on which sheaves or pulleys are mounted for guided support of the wire or fiber rope on which the personnel carriers, such as chairs, gondolas, etc., are secured. As used herein, the expression "aerial tramway" shall include chairlifts, gondolas, ski lifts, trams and other wire or fiber rope mounted personnel conveying devices which are moved in an endless loop or are shuttled or reciprocated between stations. Usually the aerial tramway tower includes a pair of rocker arm assemblies to which the rope supporting sheaves are rotatably mounted. A typical rocker arm design includes a pair of sheaves mounted proximate opposite ends of a rocker arm, with the middle of the arm being pivotally mounted to a support structure. In a large rocker arm assembly there may be four rocker arms on which eight sheaves are mounted. The four rocker arms will be supported from pairs of intermediate rocker arms, and the pairs of intermediate rocker arms supported from opposite ends of a common even larger base or support rocker arm. The base or support rocker arm is, in turn, pivotally mounted to a transversely extending tower arm.

This rocker arm assembly construction allows the various rocker arms to pivot so as to accommodate and evenly support the haul rope, even when a carrier grip passes over the sheaves. The various pivotally mounted rocker arms can rock, walk or pivot to accommodate irregularities along the length of the wire rope and dynamic load changes on the rope.

One of the most important aspects of any aerial tramway rocker arm assembly is that the assembly be constructed in a manner which allows the incorporation of haul rope catching devices into the assembly. Thus, should the haul rope jump or derail from the sheaves, the rocker arm assembly should include means for catching the rope to prevent the personnel carrier from falling to the ground. Where possible, the rope catching device should redirect the rope back onto the sheaves.

Providing a rope catching structure on the inward or tower side of a rocker arm assembly is relatively easy. As used herein, the "inward" side of the rocker arm assembly shall mean the side of the assembly on which the hanger arm for the personnel carrier does not pass. When a central tower is employed having transversely extending arms on which the rocker arm assemblies are mounted, the inward side is the side closest to the central tower. The "outward" side of the rocker arm assembly is the side on which the hanger arm does pass.

Since the hanger arm does not pass over the inward side of the assembly, it is a relatively simple matter to provide a deflector arm or post which extends alongside and up above the rope proximate the lead and trailing sheaves of the rocker arm assembly. This deflector or rope catcher will prevent the haul rope from crawling up over the inside of the lead and trailing sheaves and will deflect the rope back down onto the sheave assembly.

On the outwardly facing side of the rocker arm assembly, however, the problem of catching or preventing the rope from jumping from the sheaves is much more substantial. Any rope catching structure must not interfere with passage of the hanger arm over the rocker arm assembly and the support sheaves. In prior aerial tramways, the rope catcher on the outward side of the rocker arm assembly has been provided by an arm or post which is mounted outwardly of the sheaves or rockers so as to catch the rope in the event that it should jump off of the sheaves. For most towers there will be considerable downward force on the rope as a result of the load, and the haul rope will drop downwardly immediately upon derailing from the sheaves. As it is downwardly displaced, the rope will become hooked or caught on the outside rope catcher. As will be understood, some towers will have rocker arm assemblies which hold the rope down. In those instances the rope catcher on the outside of the assemble presents little problem since the hanger arm need not pass over the outside rope catcher.

Various devices have been provided on rocker arm assemblies to shut down an aerial tramway as soon after the haul rope leaves the sheaves as possible. Typical of such prior art derailment actuated shutdown devices are the apparatus set forth in my U.S. Pat. Nos. 4,019,002 and 3,822,369 and my pending U.S. patent application Ser. No. 207,259, filed Nov. 17, 1980 now U.S. Pat. No. 4,363,945 and entitled "Cable Derailment Responsive Apparatus." One serious problem that has been encountered with prior rocker arm assemblies and rope catchers, however, has been that while the haul rope will be caught by the rope catcher upon jumping from the sheaves, the hanger arm on the next carrier will be pulled into the rope catcher before the lift can be stopped by the derailment responsive shutdown device. If the haul rope jumps the sheaves just after the hanger arm passes the sheave assembly, the aerial tramway will normally be shutdown before the next hanger arm reaches the rope catcher. Statistically, however, it is almost certain that situations will occur in which the rope will jump from the sheaves just as a hanger arm approaches the rocker arm assembly. The result will be that the hanger arm hits the rope catcher before the lift can be stopped, which can result in a violent decelleration of the rope, jumping of the haul rope over the rope catcher, or breaking of the rope catcher free of the rocker arm assembly, all with potentially dangerous consequences.

Rocker arm assemblies have typically heretofore been constructed in one of four manners. In the first case, the sheaves are cantilevered from an outward side of the rocker arms. The rocker arms in turn are cantilevered from an outward side of intermediate rocker arms, which in turn are cantilevered from the outward side of the base or assembly rocker arm. Rope catchers are provided as post or hooked shaped catchers proximate the lead and trailing sheaves and are secured to the lead and trailing rocker arms. This structure has the advantage of positioning all of the sheaves on the outward facing side of the assembly, which enables their easy replacement. A second type of prior rocker arm assembly construction is shown in my U.S. Pat. No. 4,019,002. In this patent, the sheaves are mounted in yoke-like rocker arms, which in turn are mounted in successively larger yokes, with the base or largest yoke being cantilevered from the tower arm. This structure affords certain advantages in enabling placement of rope catching posts, but it has the disadvantage of requiring pivoting of the yokes and holding of the same in a pivoted position for replacement of all but the lead and trailing sheaves.

A third prior rocker arm construction has included rocker arms in which the sheaves are supported above the various rocker arms so that the center line of the sheave axles is above the center line of the rocker arm pivot pins. This has the advantage of making the sheaves accessible for replacement, however, the mounting of rope catchers is more difficult.

In a fourth type of prior rocker arm assemblies, the sheaves are cantilevered on the outside of the rocker arm, but the rocker arm has a C-shaped cross section so that the sheaves and haul rope are suspended below the pivot points of the rocker arms. While the sheaves are self-aligning to some degree, this construction makes the outward rope catchers less able to support the haul rope due to the tendency of the sheaves to swing inwardly when loaded.

In all prior rocker arm assemblies, considerable care must be taken so that the rockers allow clearance for the hanger arm and chair parts at all possible angles of swing. The aerial tramway codes require that the rocker arm assembly be constructed so that it will allow for clearance of the hanger arm for carriers which are swung inwardly by 10 to 15 degrees.

Maintenance of prior rocker arm assemblies has been largely accomplished by means of clambering over the tramway tower arms out to the rocker arm assemblies using a platform mounted on one of the carriers and climbing onto the tower if necessary, or using a vehicle having a cherry picker, personnel carrying platform. Since many tramway towers are inaccessible to vehicles, the cherry picker approach is not suitable in many instances. Climbing over the tower arms from the ground or from a platform on a carrier, particularly when the towers are sloped and the terrain is steep, can pose a safety problem. Accordingly, in recent years aerial tramway code requirements have tended to move toward requiring a platform on the aerial tramway tower which can be used by repair and maintenance personnel to service the sheaves and the derailment shutdown apparatus of the rocker arm assemblies for the aerial tramway.

Prior rocker arm service platforms, however, have been added largely as an afterthought, and their design has not been integrated or coordinated to any significant degree with the rocker arm assemblies. Essentially, walkways or platforms have merely been mounted to the transverse tower arms, with the result that the platforms are awkward to use, unsightly, cause snow build-up, and often do not afford good access to the rocker arms. The rocker arms, moreover, were not designed, in many cases, for servicing from the inside or tower side of the rope, making tower mounted platforms of little assistance during maintenance and repair.

The rocker arm assembly mounted derailment responsive apparatus previously employed, including my above referenced inventions, have tended to employ one of two operating principles. Either a frangible element is impacted or struck by the derailing haul rope or derailment of the rope results in movement of the sheaves which is sensed and used to shutdown the tramway. There can occur, however, situations in which the haul rope does not hit the frangible element or the sheaves do not move significantly upon derailment.

OBJECTS OF THE INVENTION

Accordingly, it is an object of the present invention to provide a rocker arm assembly for an aerial tramway or the like which has enhanced safety and simplicity of construction.

Another object of the present invention is to provide a rocker arm assembly for support of a haul rope for an aerial tramway which includes an improved rope catching structure.

A further object of the present invention is to provide a rocker arm assembly for support of a haul rope for an aerial tramway in which the rocker arm components are constructed and supported to minimize wear and fatigue.

Still a further object of the present invention is to provide a rocker arm assembly for an aerial tramway or the like in which the rope supporting sheaves of the assembly are all mounted for easy and independent maintenance and removal.

A further object of the present invention is to provide a rocker arm assembly for an aerial tramway or the like which is simple to construct, durable, adaptable to mounting on a wide range of support structures, and serviceable with relatively simple tools and equipment.

It is a further object of the present invention to provide a service platform for aerial tramway rocker arm assembly which provides increased safety for repair and maintenance personnel.

Another object of the present invention is to provide a rocker arm assembly and service platform which are integrally formed and coordinated for ease of repair and maintenance of the rocker arm assembly.

Still another object of the present invention is to provide an aerial tramway repair and maintenance platform which can be used to install and maintain rocker arm assemblies and sheaves and provides greatly enchanced access to sheaves on both sides of the aerial tramway tower.

Still another object of the present invention is to provide a maintenance and repair platform for rocker arm assemblies on an aerial tramway which is inexpensive to construct, may be easily added to existing towers, is highly durable, will not cause snow build-up, and will not interfere or inhibit tramway operation.

A further object of the present invention is to provide a rocker arm assembly having an improved rope derailment responsive tramway shutdown apparatus.

Another object of the present invention is to provide a rope derailment responsive apparatus which has improved reliability of operation.

Still a further object of the present invention is to provide a rope derailment responsive apparatus which is actuated by either haul rope impact or rope derailment from the rocker arm assembly.

The rocker arm assembly of the present invention has other objects and features of advantage which will become apparent from the following description of the preferred embodiment and the accompanying drawing.

SUMMARY OF THE INVENTION

The rocker arm assembly of the present invention includes rocker arm means, haul rope supporting sheaves rotatably mounted to the rocker arm means, and rocker arm mounting means formed for pivotal mounting of the rocker arm means outwardly from a support structure. The assembly further preferably includes haul rope derailment responsive apparatus formed to shutdown the tramway and a maintenance and repair platform.

The improvement in the rocker arm assembly comprises, briefly, the sheaves being cantilevered inwardly from the rocker arm means for support of the haul rope inwardly of the rocker arm means. Additionally, it is preferable that the rocker arm means are formed with rope catching means, such as a groove or recess, on an upwardly facing surface thereof and that the rocker arm means are formed for passage of the hanger arm of a personnel carrier over the rocker arm when the haul rope is caught by the groove or recess in the rocker arm.

In another aspect of the present invention, a tower mounted maintenance and repair platform for an aerial tramway is provided which includes platform mounting means formed for securement to the tramway tower, platform means formed for support of personnel thereon and secured to said platform mounting means, and rocker arm assembly mounting means carried by said platform means and formed for receipt and support of a rocker arm assembly thereon.

Finally, the improved rocker arm assembly includes haul rope derailment responsive apparatus mounted to the rocker arm means and formed with an electrical circuit coupled to terminate tramway operation. The improved rope derailment responsive apparatus has a frangible element positioned on the rocker arm for impact by the rope and circuit breaker means formed to break said frangible element upon movement of the rocker arm means when the rope derails and fails to be caught by the rocker arm.

DESCRIPTION OF THE PREFERRED EMBODIMENT

Figure 1:
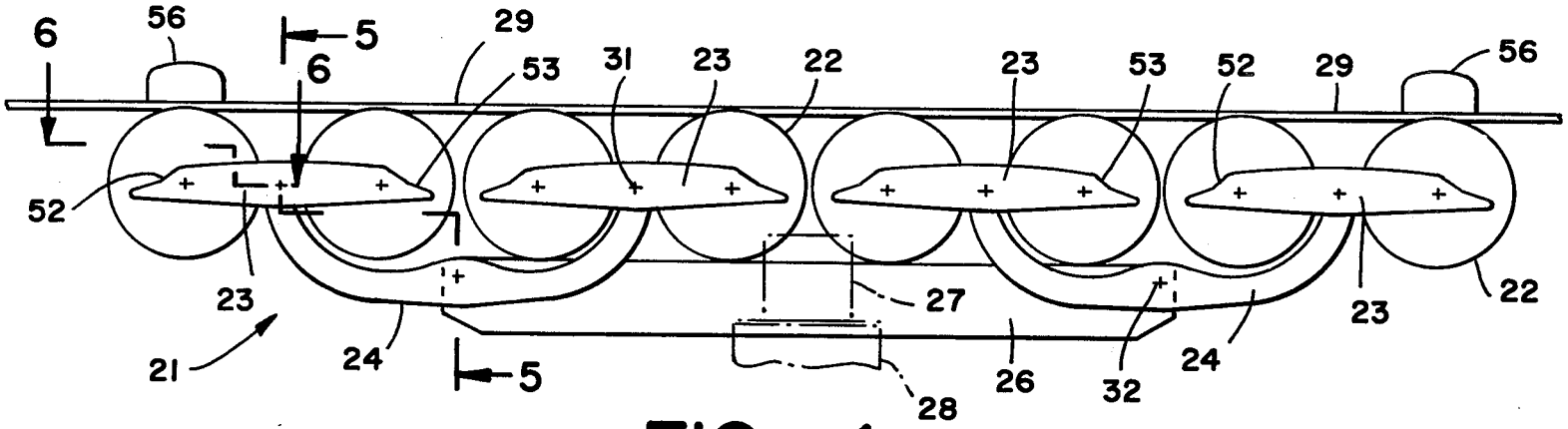
FIG. 1 is a side elevational view of a rocker arm assembly constructed in accordance with the present invention.
Figure 2:
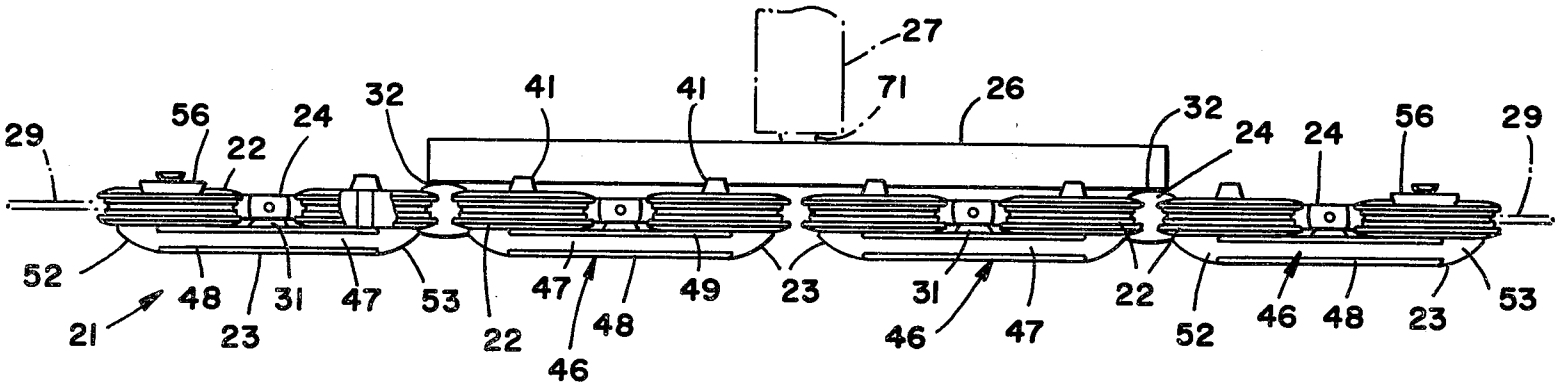
FIG. 2 is a top plan view of the rocker assembly of FIG. 1.

The rocker arm assembly as shown in FIGS. 1 and 2 of the drawing is an eight sheave rocker arm assembly, which is particularly useful in illustrating the improvements of the present invention. It will be understood, however, that the rocker arm assembly construction of the present invention is suitable for use with four sheave assemblies (FIG. 8), three sheave assemblies (FIGS. 11 and 12), two sheave assemblies, sixteen sheave assemblies, and various other numbers of sheaves.

In FIGS. 1 and 2, the rocker arm assembly, generally designated 21, includes eight sheaves 22 mounted to a plurality of sheave carrying rocker arm means 23. Each of the sheave carrying rocker arms 23 in turn is mounted to an intermediate rocker arm 24, and the two intermediate rocker arms 24 are pivotally mounted to an assembly rocker arm 26, which is pivotally mounted to a support structure, such as the transverse arm 27 of tramway tower 28.

As will be described in more detail hereinafter, each of sheaves 22 is rotatably mounted to the sheave carrying rocker arms 23 for movable support of the aerial tramway wire or fiber haul rope. In the assembly shown in the drawing, each of the sheave carrying rocker arms 23 has a sheave mounted proximate the end thereof, and they are accordingly referred to in the industry as "two-sheave rockers." Since the two-sheave rockers are pivotally mounted at 31 to intermediate rocker arm 24, the intermediate rocker arm 24 carries a total of four sheaves and is referred to as a "four-sheave rocker." The assembly rocker arm 26, which has two four-sheave rockers pivotally mounted thereto at pivot points 32, is also known as an "eight-sheave rocker."

As is true with conventional rocker arm assemblies, the purpose of pivotally mounting the various rocker arms to each other and to the support arm 27 on the tower is to cause the sheaves to automatically adjust to the load on haul rope 29. The pivoting or rocking of the various rocker arms allows the sheaves to in effect walk or be rocked progressively as irregularities in the rope, the carrier grips and load on the rope are transmitted to the assembly. This dynamic action of the rocker arm assembly enhances the even support of the haul rope and tends to prevent the rope from climbing up and falling off the sheaves.

Figure 3:
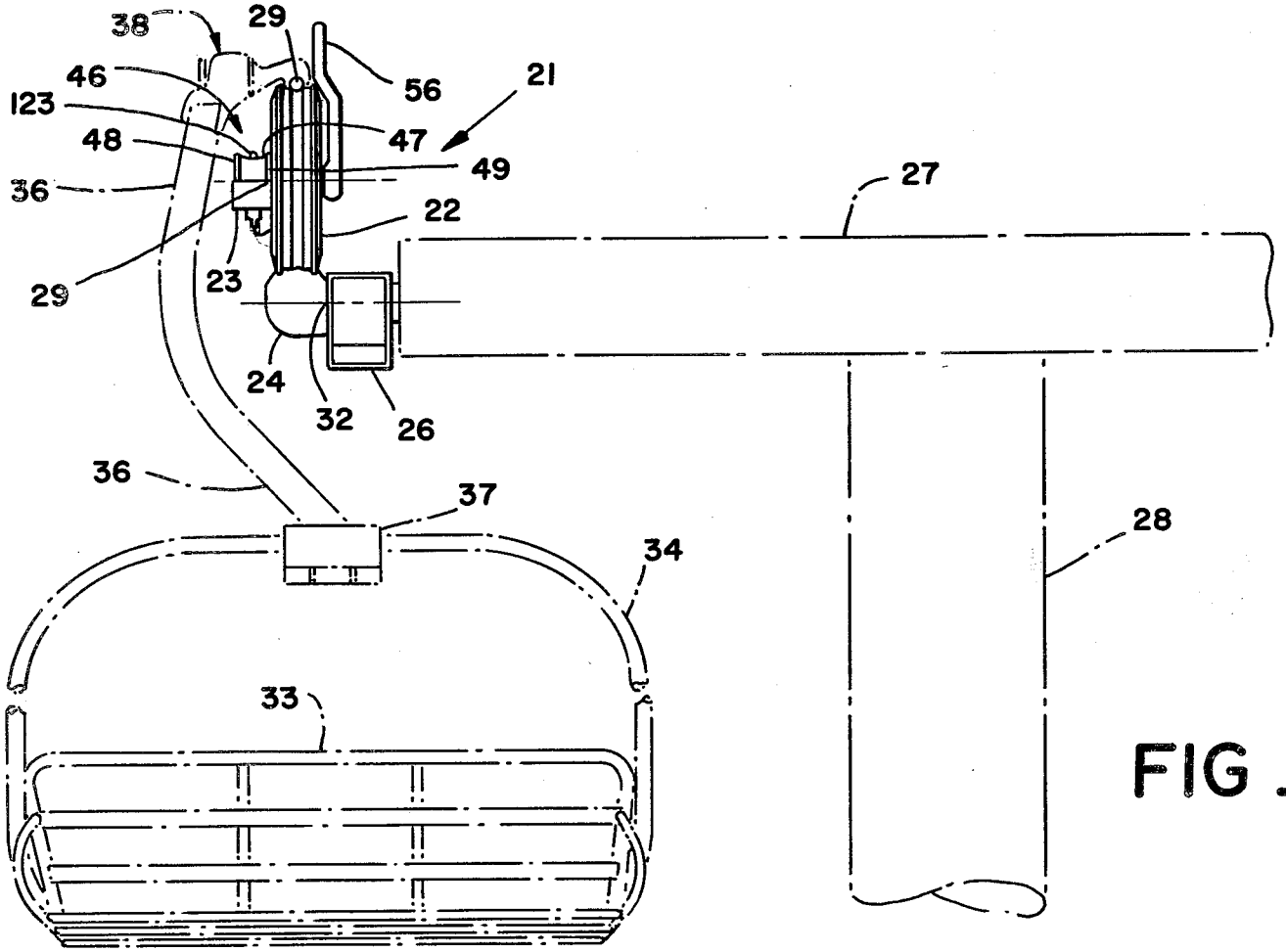
FIG. 3 is a end elevational view of the assembly of FIGS. 1 and 2 with a chair shown in phantom supported therefrom.

Rocker arm assemblies are used in various types of aerial tramways. As shown in FIG. 3, triple chair 33 is supported by frame 34, which is coupled to hanger arm 36 by a mounting assembly 37, preferably constructed as set forth in my U.S. Pat. No. 4,179,994. As will be understood, however, other personnel carriers, such as a gondola, tram body, or even a ski lift support seat, can be coupled to hanger arm 36. The upper end of hanger arm 36 will be provided with a rope grip, generally designated 38, which can take a number of different forms. Grip 38, for example, can be permanently or removably attached to rope 29. Moreover, the grip 38 can be buried inside a wire rope or formed with rope clamping jaws that grip the outside of the rope. Usually the grip is provided with motion damping means to minimize the swing of the hanger arm, such as is described in my co-pending U.S. Application Ser. No. 249,003, now U.S. Pat. No. 4,401,198 entitled "Friction-Based Motion Damping Assembly for Chairlift or the Like."

The rocker arm assembly of the present invention as thus far described includes structure which is found in prior aerial tramway rocker arm assemblies. Thus, rope supporting sheaves 22 have conventionally been rotatably mounted to rocker arm means, such as rocker arms 23, and mounting means have been provided for pivotal cantilevered mounting of the rocker arm means 23 to a support structure, in this case intermediate rocker arms 24, assembly rocker arm 26, transverse tower arm 27 and support tower 28.

In the improved assembly of the present invention, however, while rocker arms 23 are outwardly cantilevered from support rocker arms 24, sheave means 22 are cantilevered inwardly toward the support structure from rocker arm means 23. This results in a positioning of haul rope 29 inwardly of the rocker arm means 23, which can best be seen in FIGS. 3, 5 and 6. More particularly, the two-sheave rocker arm 23 can be seen to be cantilevered outwardly on pivot member or shaft 31 from four-sheave rocker arm member 24. Instead of cantilevering sheave 22 outwardly from the two-sheave rocker 23, as is common in the industry, and inwardly cantilevered shaft or pipe 39 is provided for rotatable support of sheaves 22. Thus, rope 29 is between the tower and the two-sheave rocker 23.

The inward cantilevering of the sheaves off of the two-sheave rockers 23 has several important advantages. First, all of the sheaves can be independently reached and removed from the assembly by simply removing the end cap 41 which is bolted by means of a bolt 42 to a nut 43 welded inside the tubular shaft 39 on which the sheaves are rotatably mounted. The sheave is then removed from the inward side of the assembly, instead of the outward side of the assembly.

Figure 4:
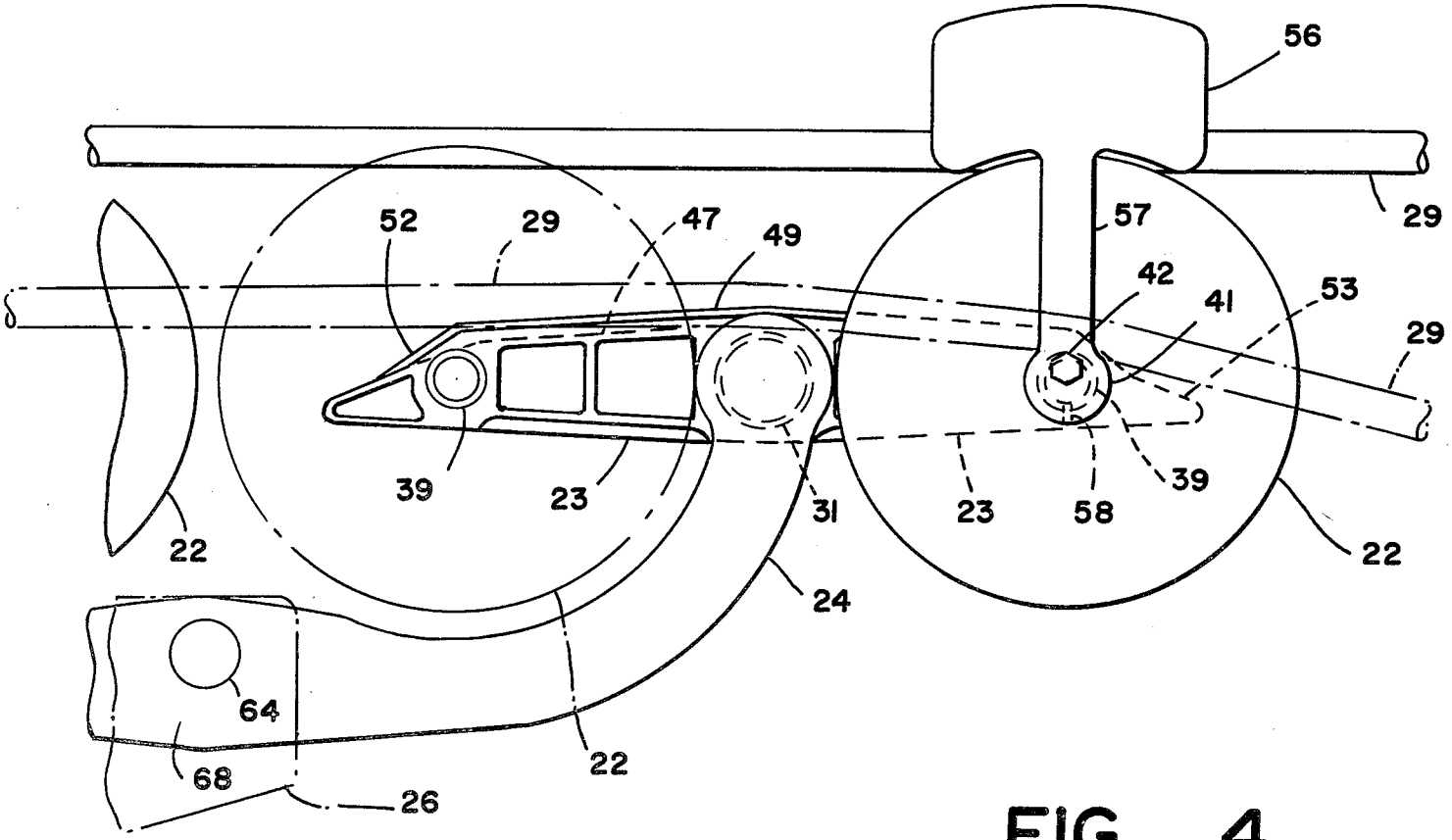
FIG. 4 is an enlarged, fragmentary, side elevational view of a portion of the assembly of FIG. 1.

A second important advantage of the inward cantilevering of sheaves 22 is that rocker arm 23 can be readily formed with rope catching means, generally designated 46, on the outward side of sheave 22. In the preferred form, rope catching means 46 is provided as a groove or recess 47 extending parallel to the haul rope in an upwardly facing side of rocker arm 23. Groove 47 can be defined on the inner and outer sides by ridges 48 and 49 which extend longitudinally so as to assist in retaining the rope should it jump or derail from the sheaves. As will be seen in FIGS. 4 and 5 in phantom, rope 29 will be supported and rest in groove 47 along the two-sheave rockers of the assembly in the event that it should climb up over the outer rim of 51 (FIG. 5) of sheave 22.

It is a further important feature of the present invention that the rocker arm and rope catching groove 47 be formed for passage of the rope and hanger arm 36 and grip assembly 38 over the rocker arms or along the rope catching grooves when the rope is supported in the grooves. Thus, rocker arms 23 can be seen to be formed with rounded leading and trailing surfaces 52 and 53 which are faired into rope catching groove 47 so that there are no discontinuities or interruptions which would cause a hanger arm or grip to bounce out of the groove or stop suddenly. The rocker arm assembly of the present invention, therefore, will allow a haul rope which has derailed or jumped from the sheaves onto the groove to still advance, even when the hanger arm reaches the rope catcher, until the lift is shut down. Since it is predictable that hanger arms will be advanced to the rocker arm assembly before the lift can be shut down in at least some instances of the rope jumping from the sheaves, the rocker arm construction of the present invention greatly enhances safety as compared to previous apparatus designed to catch the haul rope on the outwardly facing side of the rocker arm assembly.

Proximate the inward rim 54 of the lead and trailing sheaves of the rocker arm assembly is a haul rope deflector or catcher 56. As will be seen from FIGS. 3 and 5, the inward rope catcher-deflector 56 can be very closely mounted to the inward rim of the sheave because the grip assembly and hanger arm do not have to pass over rim 54. Accordingly, deflectors 56 will simply re-direct a rope which tends to climb over rim 54 back down onto the sheaves. As best may be seen in FIG. 4, deflector 56 includes an arm portion 57 which extends upwardly from end cap portion 41 and can be bolted on the lead and trailing sheaves at shafts 39 instead of a cylindrical end cap 41. In order to resist any torque which the deflector may experience about shaft 39, it will be noted from FIG. 4 that bolt 42 is bolted to a nut welded to the side wall of the inside of tubular shaft 39, which results in the bolt 42 being off center and in a position to resist rotation. To further resist rotation, it is preferable to pin the deflector collar portion 41 at 58 to tubular shaft 39.

A third important aspect of the rocker arm assembly construction of the present invention is the ability to position the pivotal and rotatable bearings in substantial alignment with haul rope 29. As may be seen in FIG. 6, it would be possible to fixedly mount sheaves 22 to shaft 39 and pivot shaft 39 with respect to rocker arm means 23. In the preferred form, however, the pivotal mounting shaft 39 is integrally cast in a boss or socket 59 of rocker arm 23. Mounted on the inwardly cantilevered end of the shaft 39 is the bearing assembly, schematically shown at 61, for sheaves 22. Thus, sheave bearing assembly 61 is positioned in substantial alignment with, and in this case beneath, rope 29. While the rocker arm assembly of the present invention is shown with the rope mounted on top of the sheaves, it will be readily apparent to those in the industry that in some assemblies, the sheaves hold the haul rope down and the assembly would essentially be inverted. This would position the rope below the various bearings, but whether below or above, the rope will be in general alignment with bearings 61 and the pivotal mounts for the various rocker arms in the assembly.

In the preferred form of the assembly of the present invention the pivotal shaft 31 between the two-sheave rocker arms 23 and the support rocker arms 24 is also cast in a boss or socket 62 and extends inwardly from the two-sheave rocker arm. Mounted on the inwardly extending end of pivotal shaft 31 is a rocker arm bearing 63 (preferably a low-friction sleeve such as a TEFLON sleeve) on which is carried by the four-sheave rocker arm 24. Bearing 63 will be seen to be aligned with rope 21 so that wear and loading of rocker arm bearing 63 will be even. Moreover, as best may be seen in FIG. 5, a pivot shaft or pin 64 between eight-sheave rocker arm 26 and four-sheave rocker arm 24 can be rigidly secured in the eight-sheave or assembly rocker arm 26 and mounted for pivotal movement by another rocker arm bearing 66 (e.g., a TEFLON sleeve) in a socket 67 provided in the central portion 68 of the four-sheave rocker arm 24. As will be seen, rocker arm bearing 66 is again positioned in substantial alignment with rope 29 for even loading of this bearing.

The final pivotal mount for the rocker arm assembly is provided by a pivot shaft 71 which is journaled inside a bearing (not shown) mounted in transverse tower arm 27 and is fixedly secured to eight-sheave rocker arm 26. Pivotal shaft 71 cannot be provided with bearings mounted underneath or in alignment with rope 29, but is possible to provide very large bearings in arm 27 so that the cantilevering of shaft 71 with respect to the load on rope 29 can be readily supported. The size of the bearing for shaft 71, therefore, can be selected so that wear and maintenance are not a substantial problem.

The inward cantilevering of sheaves 22 plus selection of which elements pivot with respect to the remaining elements, therefore, results in alignment of sheave bearings 61 and rocker arm bearings 63 and 66 directly under the rope load for even wear. This is a substantial benefit as compared to pivotal mounting arrangements in which the bearings must support a cantilevered load.

Figure 5:
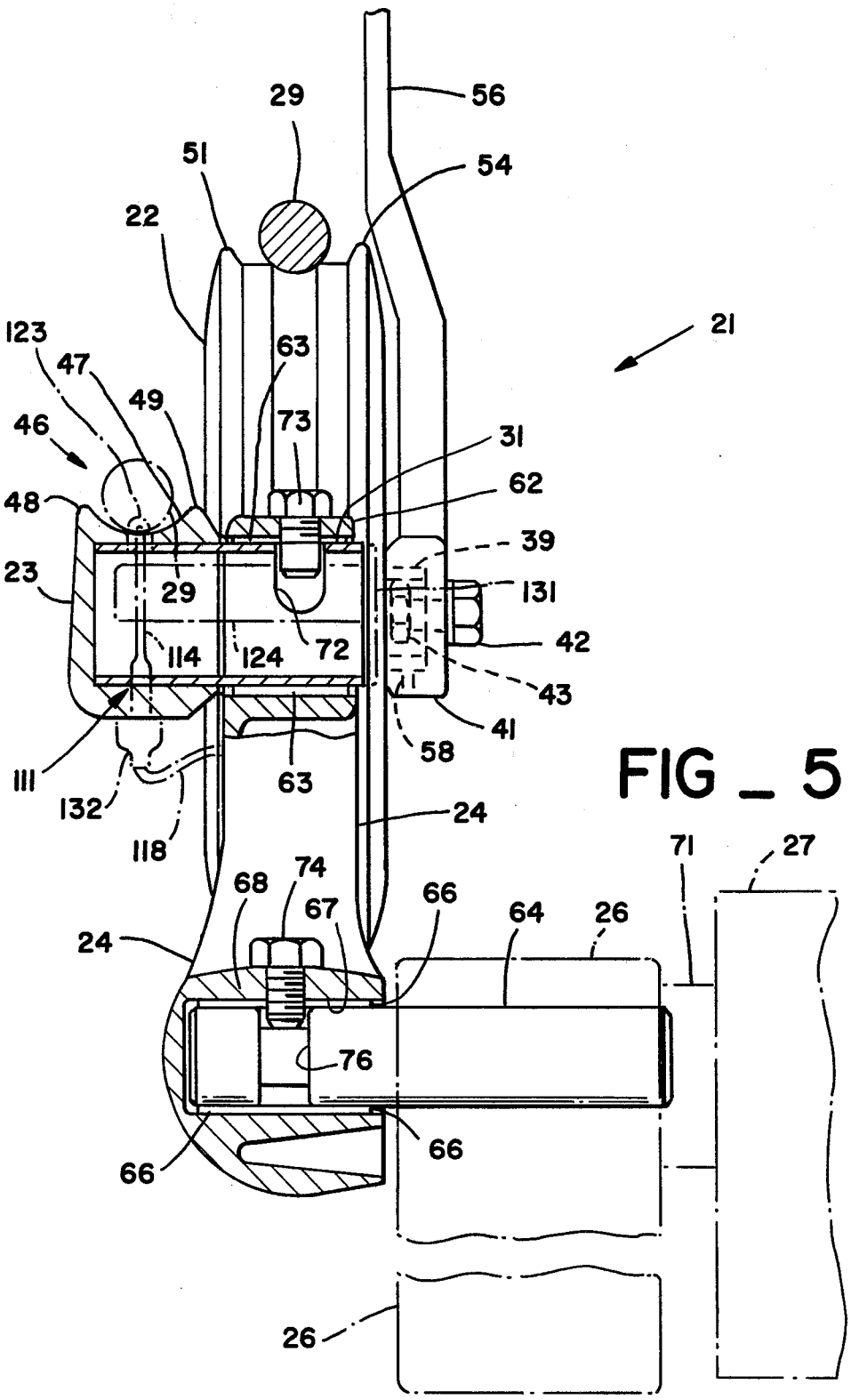
FIG. 5 is an enlarged end elevational view, partially in cross-section, and taken substantially along the plane of line 5—5 in FIG. 1.

As best may be seen in FIG. 5, one manner of securing two-sheave rocker 23 to four-sheave rockers 24 is to form a slot 72 in tubular member 31 into which bolt 73 can extend. Boss or socket 62 is threaded to receive bolt 73, and slot 72 extends circumferentially a sufficient distance to accommodate rocking or pivoting of rocker 23.

A similar structure is used to secure pivot pin or axle 64 to the middle of four-sheave rocker 24. Thus, bolt 74 is threaded through boss 68 and projects into a notch or groove 76 in pin 64. Other securement structures are possible, but an advantage of the above structure is its universal nature. If, for example, an assembly is to include only two sheaves, the pin 64 can be mounted inside tube 31 and a bolt 73 will protrude into notch 76. It is a further feature of the present invention that the pin 64 and tube 31 be formed for telescopic mounting together and that notch 76 and slot 72 can be superimposed.

Figure 7:
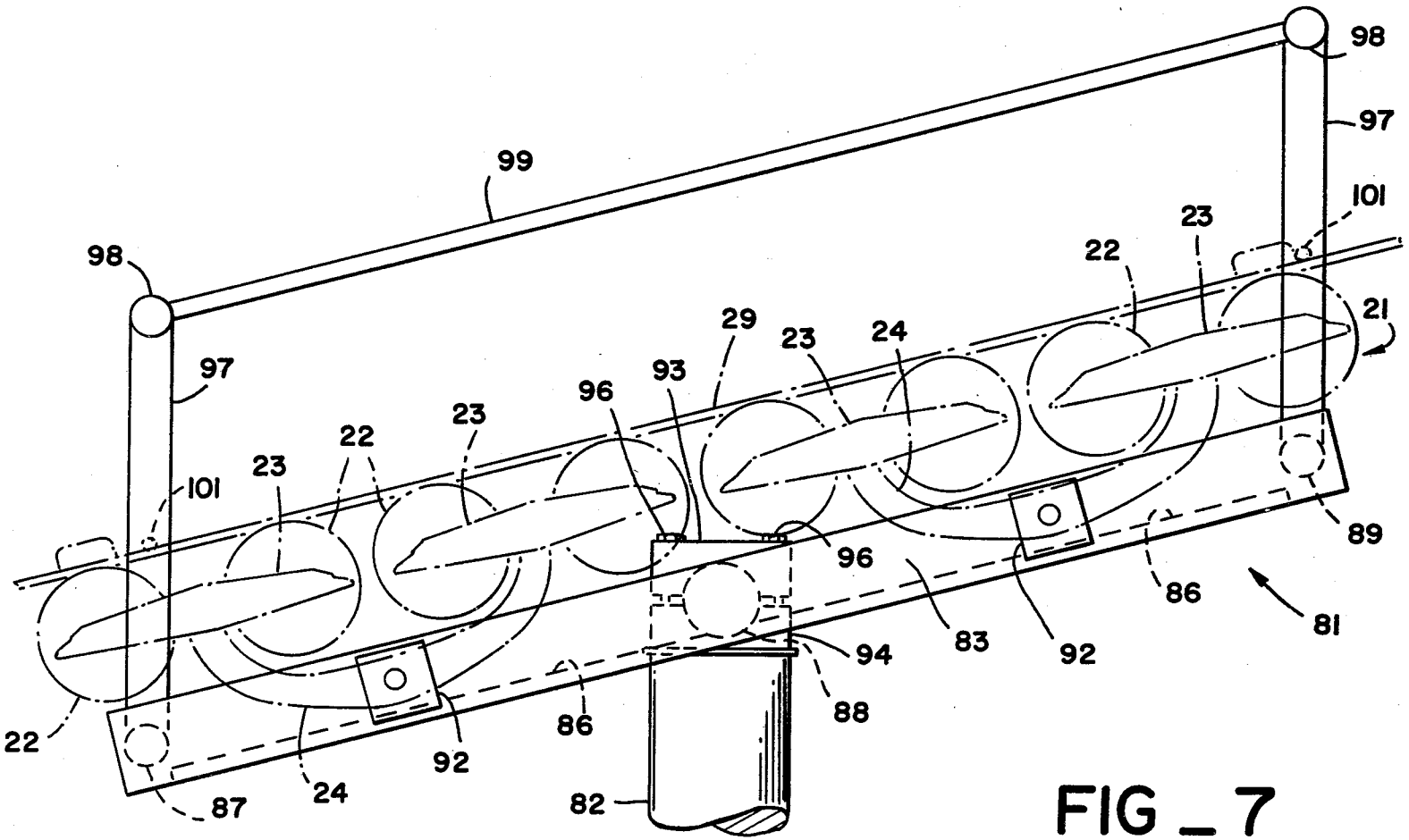
FIG. 7 is a side elevational view of a rocker arm assembly having a maintenance and repair platform with the rocker arm portion of the assembly shown in phantom.
Figure 8:
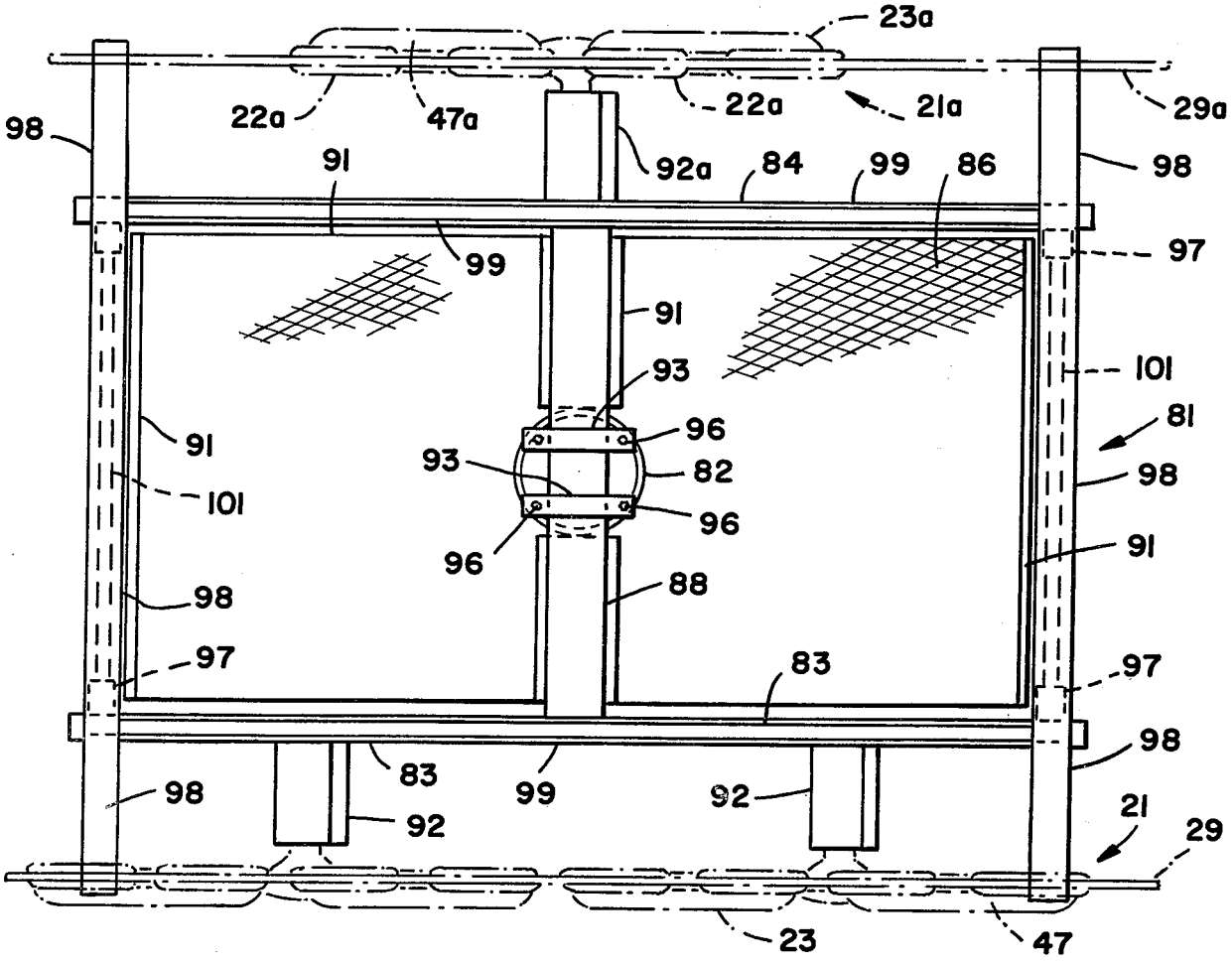
FIG. 8 is a top plan view in slightly reduced scale of the maintenance and repair platform of FIG. 7.

In recent years tramway codes have begun to require that the aerial tramway towers include a personnel support platform for maintenance and repair of sheaves and rocker arm assemblies. FIG. 7, 8, 11 and 12, illustrate platform means which have been incorporated into and form a part of the tower structure and rocker arm assembly of the present invention. Thus, the rocker arm assemblies 21, **21*a* and 21*b* are shown mounted to platform means, which in turn are secured to towers. In FIGS. 7 and 8, platform means 81, therefore, acts as mounting means for the rocker arm assemblies 21 and 21*a*, the latter of which is a four-sheave assembly on the return side of the tramway haul rope. In FIG. 12 platform means 141** is incorporated into what is essentially the seven-sheave rocker (an assembly of a four-sheave rocker and a three-sheave rocker) as is described in more detail hereinafter.

In FIGS. 7 and 8, platform means 81 is constructed out of side frame members 83 and 84 to which a preferably open platform surface, such as expanded metal member 86, is secured. The side frames are held in rigid spaced apart relation by three cross bracing tubular members 87, 88 and 89, with the expanded metal platform 86 being supported on frame elements 91 to provide a rigid surface which will support several maintenance and repair workers. The use of an expanded metal for the platform surface tends to reduce snow and ice build up on the tower.

As best may be seen in FIG. 7, the platform 86 is positioned proximate rocker arm assemblies 21 and **21*a* so that the sheaves 22, two-sheave rockers 23, and four-sheave rockers 24 are easily accessible to personnel on the maintenance platform. Moreover, the inward cantilevering of sheaves 22 from two-sheave rockers 23** affords workers ready access to remove the sheaves anywhere along the rocker arm assembly by pulling them inwardly toward the platform.

Rocker arm assembly 21 is an eight-sheave assembly in which the eight-sheave rocker 26 of FIGS. 1 and 2 has been replaced by beam or frame member 83. Each of the four-sheave rockers 24 is mounted to a laterally extending rocker arm mount 92, which is rigidly secured to frame member 83. Frame member 83 inturn is rigidly secured to transverse pipe 88 that is clamped by means of mounting clamps or brackets 93 proximate the top or upper end 94 of tower 82.

As shown in FIG. 7, rocker arm assemblies are usually secured to the tower on which they are mounted at an angular orientation other than perpendicular. This angle can vary considerably, and the tower 82 can be oriented in a vertical direction as shown in FIG. 7 or angularly displaced from the vertical, depending upon the tower design and the terrain.

The platform mounting means or clamp structure 93 allows platform 82 to be angularly adjusted with respect to tower 82. Once the platform and accordingly the rocker arm assemblies are properly oriented in accordance with the tramway design, fasteners 96 can be tighted to lock the angular orientation of the platform in place. If necessary or desirable, the cross beam 88 can even be welded to clamp members 93 or the fasteners can be welded against backing out of the mounts.

Such a rigid securement of the angular orientation of side beams 83 and 84 takes the pivotal mounting out of what was the eight-sheave rocker 26. It has been found, however, that eight-sheave rockers, under maximum load variation, will undergo an angular displacement at the pivot mount 71 of only about 1 to 1½ degrees. The displacement of the two-sheave and four-sheave rockers, therefore, will accommodate a wide range of loading conditions, and fixing the eight-sheave rocker such as by clamps 93 (or four-sheave rocker on the return side) will not induce unacceptable stress variations in the tower or haul rope.

On the return side of the tower, four-sheave rocker arm assembly **21*a* is mounted to a transversely extending amount 92*a* and is preferably constructed with rocker arms 23*a* from which sheaves 22*a* are inwardly cantilevered. Additionally, the two-sheave rockers 23*a* are preferably formed with a groove or recess 47*a* which extends parallel to rope 29*a*** on the outward side of the rope to act as rope catching means.

The lateral extending mounts 92 and **92*a* position the rope outwardly of platform 86 at a distance which ensures that the platform will not obstruct tramway operation and yet the platform is close enough to make working on the sheaves relatively easy. Typically, the lateral mounts 92 and 92*a* will extend about 1 to 2 feet outwardly from platform side frame members 83 and 84**.

It is a further important advantage of the platform and rocker arm assembly of the present invention that the platform means be provided with hoist support means positioned in superimposed relation over haul rope 29 and **29*a*. Thus, the platform includes posts 97 on which laterally extending cross beams 98 are mounted. Beams 98 extend to a position superimposed above rope 29 and 29*a*, as best may be seen in FIG. 8. The extension of transverse beams 98 beyond side frames 83 and 84 affords a member to which a hoist or the like can be secured to enable raising and lowering of a variety of components during construction and maintenance of the towers. Thus, the rocker arm assemblies, sheaves and rope can all be hoisted off of transverse beams 98** and held in position until the construction or repair is completed.

Finally, it is an important feature of the platform and rocker arm assembly of the present invention to provide rail means 99 which extends substantially around the periphery of platform 81. Rail means 99 acts as a restraining device so that the personnel will not inadvertently fall from the platform. The transverse members 98 further function as rails along the ends of the platform, as do cross bracing members 101 between the posts 97. It is preferable to mount the longitudinally extending rail members 99 to cross beams 98 and to mount posts 97 to cross members 87 and 89 in a manner which allows angular displacement of the posts and rails as a parallelogram in order to accommodate the angular displacement of side frames 83 and 84 during set up and clamping of the platform to tower 82. Once the platform is positioned, the rails and posts can be locked in their angular orientation by clamps, fasteners or even welding.

As will be understood, the rocker arm assembly of the present invention can be pivotally mounted on an eight-arm rocker to a transversely extending member, such as member 88 so that the assembly will pivot or rock independently of the platform means 81. The platform would, in that instance, still provide the advantages of access and safety without acting as mounting means for the rocker arm assembly.

Figure 11:
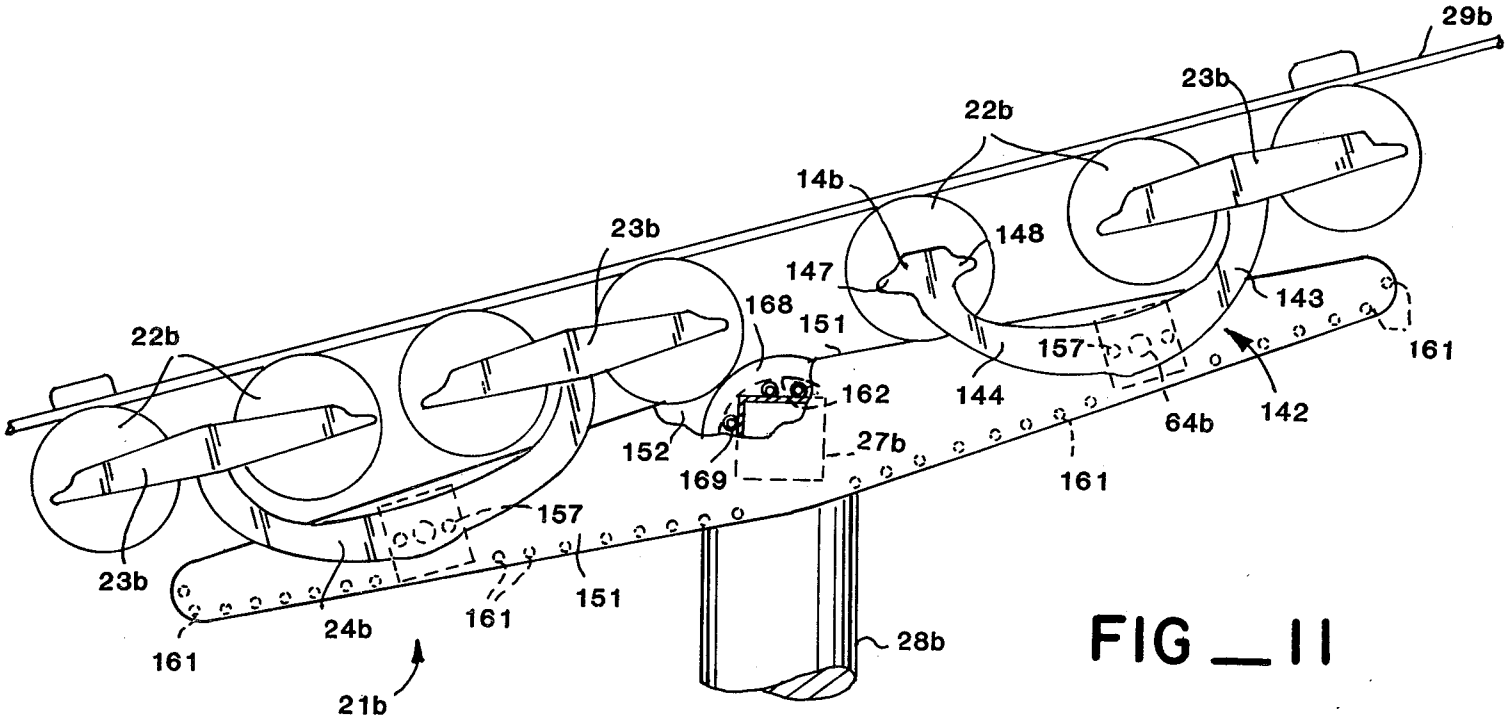
FIG. 11 is a side elevational view corresponding to FIG. 7 of an alternative embodiment of the rocker arm assembly with a maintenance platform incorporated therein.
Figure 12:
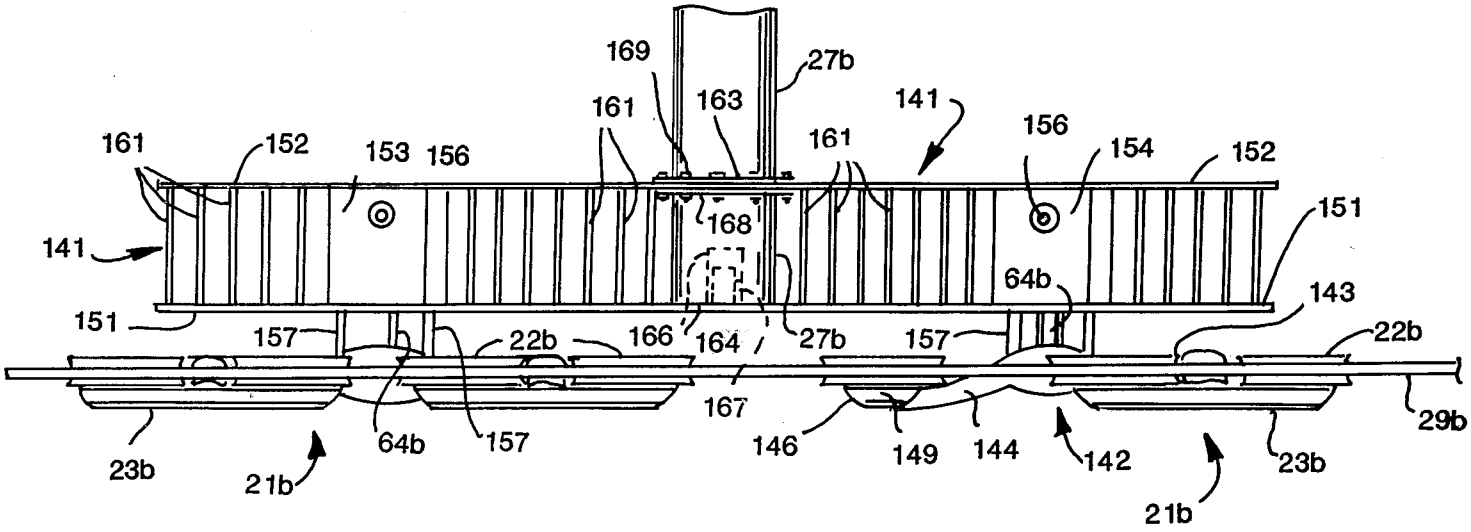
FIG. 12 is a fragmentary top plan view in slightly reduced scale of the rocker arm assembly of FIG. 11.

FIGS. 11 and 12 illustrate an alternative embodiment of a rocker arm assembly **21*b* which includes platform means 141. Instead of providing eight sheaves, assembly 21*b* includes seven sheaves 22*b* which support haul rope 29*b*. The left sub-assembly in FIGS. 11 and 12 is a four-sheave rocker including a pair of two-sheave rockers 23*b* and four-sheave rocker 24*b*, constructed as above described for the assembly of FIGS. 1 through 6. The right sub-assembly in FIGS. 11 and 12 is a three-sheave rocker 142 including a two-sheave rocker 23*b* mounted on arm 143 and a single sheave mounted on arm 144**.

Three-sheave rocker 142 has arms 43 and 144 which have a length selected so that the moment about pivot pin **64*b* is zero. Thus, the arm 143 is shorter than arm 144 so that there is no imbalance in the moment about pivot 32*b*** as a result of the presence of two sheaves on one arm and one sheave on the other.

Arm 144 is preferably formed to extend outwardly from tower **28*b* as compared to arm 143 (best seen in FIG. 12) so that the sheave mounted on arm 144 can be inwardly cantilevered and rope catching means 146 can be provided outwardly of rope 29*b*. Rope catcher 146 is formed in a manner similar to rope catcher 23*b* with faired lead end 147 and trailing end 148 and a rope catching groove 149**.

Instead of providing platform means 141 as a platform which extends across the tower (some towers have a haul rope on only one side), platform 141 is provided by forming the seven-sheave "rocker" as a pair of spaced-apart plate members 151 and 152 which are mounted to transverse tower arm **27*b***. The seven-sheave "rocker" is not a true rocker since it is not free to pivot, as will be set forth below.

Extending between plates 151 and 152 are a pair of rectangular mounting housings 153 and 154 which include pivot post or pins **64*b* that can be angularly adjusted by adjustment screws 156** in a manner well known in the industry.

A pair of auxiliary rods 157 project outwardly from housings 153 and 154 and into hollows in the castings for arms **24*b* and 142 to limit to some degree the pivoting of the arms. These limit rods 157 hold the arms 24*b* and 142 in an upright position for assembly until rope 29*b* is supported on the sheaves. The openings or hollows in arms 24*b* and 142 into which the rods 15 project are of sufficient size that the rocking of the arms during dynamic loading is not inhibited by rods 157**.

Also extending between plates 151 and 152 are a plurality of bars 161 which form an open platform in immediate proximity to sheaves **23*b*. Bars 161 can advantageously be provided by ribbed reinforcing bars and they are secured proximate the bottom of plates 151 and 152 so that the sides of the plates aid the service personnel in maintaining their balance on the platform. The bar-type platform also acts as a slightly inclined ladder for arms which are sloped, as is most often the case. The openings between bars 161 are sufficient to insert the heel or toe of a boot for good traction even though plates 151 and 152** are inclined.

Securement of the rocker arm assembly of FIGS. 11 and 12 is preferably accomplished by forming plate 152 with an opening 162 sufficient to pass over square tubular tower arm **27*b*. Fixedly mounted to tower arm 27*b*, however is an inner annular collar or flange 163. Plate 152 will, therefore, abut against collar 163 when slipped over the end of arm 27*b*. The end 164 of tower arm 27*b* is closed with a plate in which an inwardly extending tube 166 is secured. Welded to the inside of plate 151 is a cylindrical member 167 which telescopes inside tube 166 as plate 152 is slid over the arm end and urged into engagement with collar 163. Before cylindrical projection 167 is inserted into tube 166, however, a second collar or flange 168 is slid down arm 27*b* until it is in abutment with the inside of plate 152. Bolts 169 are then passed through opening 162 and used to pull collar 168 toward collar 163 with plate 152 sandwiched between. Thus, a very substantial friction force is generated between collars 163 and 168 so as to enable locking of plate 152, and therefore the entire assembly, between at any desired angular orientation on arm 27*b*. When tower 28*b* is erected, therefore, plates 151 and 152 can be mounted on arm end 164 and collars or flanges 163 and 168 used to lock the arm in the desired angular orientation. Other mounting structures for the open-bar rocker arm platform of FIGS. 11 and 12** are also feasible.

Figure 9:
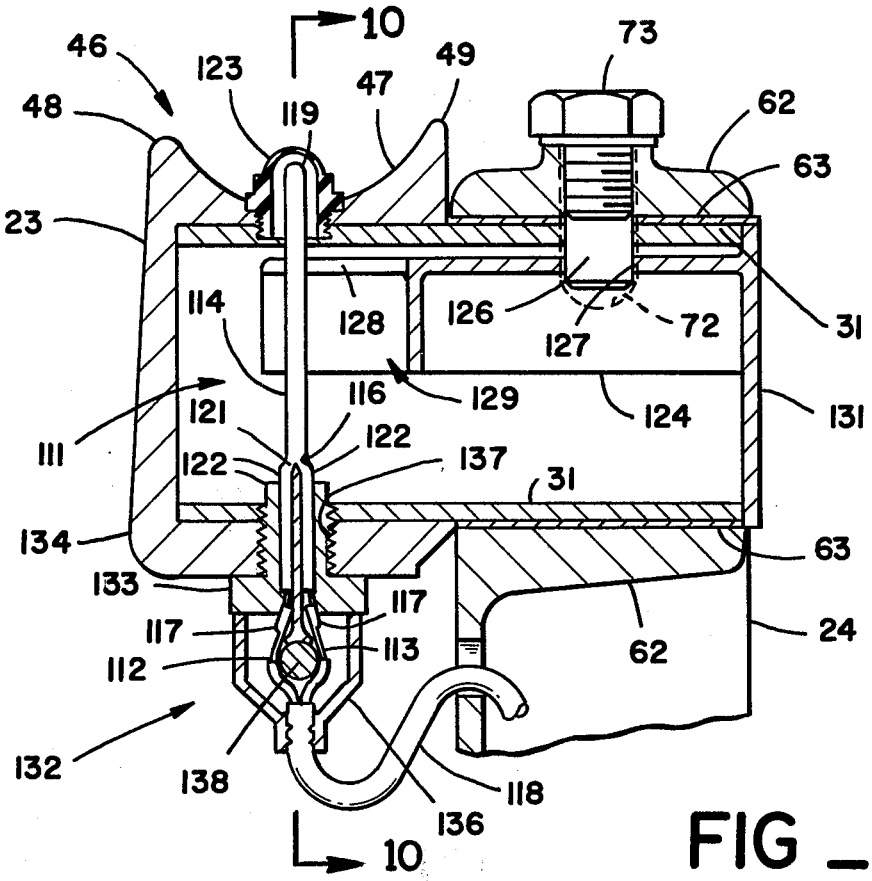
FIG. 9 is an enlarged, end elevational view, in cross-section corresponding to FIG. 5 and showing rope derailment responsive apparatus incorporated into the rocker arm assembly of the present invention.
Figure 10:
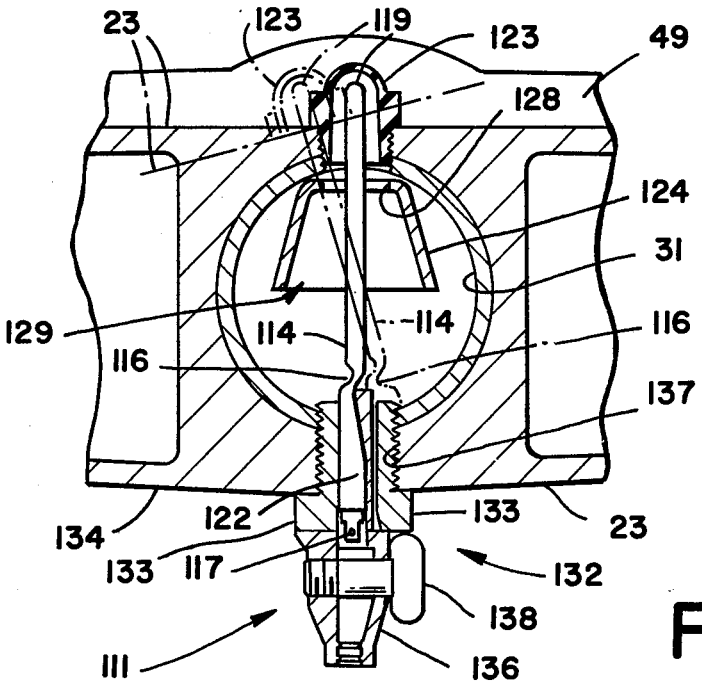
FIG. 10 is a side elevational view in cross-section taken substantially along the plane of line 10—10 of FIG. 9.

Referring now to FIGS. 9 and 10, the rocker arm assembly of the present invention can further be seen to include haul rope derailment responsive apparatus formed to terminate opration of the tramway in the event of derailment or jumping of the rope from sheaves 22. Mounted to rocker arm means 23 is rope derailment responsive apparatus, generally designated 111, which is formed with an electrical circuit coupled to terminate operation of the tramway. Thus, electrical wires 112 and 113 are coupled to frangible element 114, which has a weakened plane or notch 116 that ensures the frangible element will break or rupture at notch 116. The frangible element 114 is formed of an electrically conductive material and is coupled by connectors 117 to wires 112 and 113. Numerous materials are suitable for formation of the electrically conductive frangible element 114, but a brittle cast zinc can be advantageously used as the frangible element of the present apparatus. Wires 112 and 113 are mounted in their own insulating coverings and in turn are mounted in common sheath 118 which extends from the tram electrical control panel to each tower along the lift line.

The electrical circuit in which frangible elements 114 at each tower are incorporated can take several different forms, but preferably the frangible elements act as normally closed switches connected in series. If any one of the frangible elements is broken, the switch will open, which actuates a solenoid to in turn shutdown the drive motor driving haul rope 29. Such a circuit is described in more detail in my U.S. Pat. No. 4,019,002 and will not be repeated herein.

In order to cause breaking of frangible element 114 by rope impact, the upper end 119 of frangible element 114 protrudes above the bottom of two-sheave rocker arm groove 47. A rope which jumps or derails from the sheaves and is caught by the rope catching groove 47 will impact or strike and drive frangible element 114 downwardly. This will cause shattering of the frangible element at notch 116, with the result that there will be a gap at the apex 121 between the two conductive legs 122 of the frangible element. It is preferable to provide flexible shield means 123, such as a thin rubber cap, over the protruding end 119 of the frangible element. The shield will collapse under rope impact, and it is sealed with respect to the groove 47 so that ice and snow cannot go down inside the rocker arm axle and affect performance of the derailment responsive lift shutdown apparatus.

While positioning of the frangible element 114 for impact by rope 29 will terminte lift operation if the haul rope is caught by rope catching groove 47, there is the possibility that the rope will derail under dynamic conditions of which will cause the rope to jump free of the rocker arm and not be caught by rope catching means 46. If such a rope derailment should occur, it is a further important feature of the derailment responsive means 111 that it be formed to break frangible element 14 even upon failure of the rope to impact the frangible element. This can be accomplished by biasing the lead and trailing rocker arms for pivotal movement in the event that the rope is no longer supported on the sheaves or rocker arms. Such a biasing can be a gravity biasingby weighting of the rocker arms or a spring biasing, as is disclosed in my U.S. Pat. No. 4,019,002 and my pending application Ser. No. 207,259. The weight of the inside rope catcher 56, for example, gravity biases rocker arms 23 to rotate upon derailment of the rope from the sheaves and rocker arm. A tension spring connected between rocker arm 23 and rocker arm 24, could also be employed.

When the haul rope is supported on the rope catching grooves in rocker arm 23, the rope load would prevent rotation of the rocker arm, just at it does when the rope is supported on the sheaves. When caught, however, the rope will impact the end 119 of the frangible element to thereby destroy the same.

In the event that the haul rope derails and jumps the rocker arm, the biasing weight of rope catcher 56 will cause pivoting of the lead and trailing rocker arms 23. The rope derailment responsive apparatus of the present invention further includes a circuit breaker element 124 mounted rocker arm means 23 for movement of at least one of the frangible element 114 and circuit breaker element 124 until the circuit breaker element impacts and breaks the frangible element during rotation of rocker arm 23. In the form of the apparatus shown in FIGS. 9 and 10, circuit breaker element 124 is fixidly mounted by the end 126 of nut 73 which passed through a circular opening 127 in the circuit breaker element. Thus, the circuit breaker element remains in the same angular orientation as the four-sheave rocker arm 24, while two-sheave rocker arm 23 pivots under the biasing weight when the rope derails from the sheaves and the rocker arm. This pivoting action can best be seen in FIG. 10 where the frangible element 114 can be seen in phantom to impact the edge 128 of a slot in the end of fork-shaped circuit breaker element 124. As rocker arm 23 rotates under the biasing, frangible element 114 is sheared or broken at notch 116 when the frangible element impacts the side 128 of circuit breaking member 124.

Since rocker arm 23 will be constantly rocking under dynamic loading, circuit breaker element 124 should be formed with a fork in which slot 128 at the upper edge and at lower edge 129 will accommodate rocking without breaking the frangible element. The size of slot or fork in element 124 can vary depending upon the dynamics of each individual lift, but usually a slot which would accommodate rocking in either direction by about 15 degrees will more than suffice for even the most dynamic rocker arms. Accordingly, the biasing means for rotation of rocker arm 23 on derailment should displace the rocker arm through a substantial angle, namely, an angle great enough to ensure that the edge 128 of the forked circuit breaker element 124 impacts and breaks the frangible element.

It is further preferable that the circuit breaker element be mounted inside tubular axle 31 and below the rope supporting groove 47 so that it is not exposed to the adverse environment. In this regard, providing and end cap 131 on the end of circuit breaker element 124 effectively closes the open end of tubular axle 31 and prevents the entry of snow and ice into the inside of the axle.

Frangible element 114 is preferably mounted in electrically insulating mounting means, generally designated 132, for easy replacement. This can be accomplished by forming mounting means 132 with a first piece 133 which can be threaded into the base 134 of rocker 23 and extends through tubular axle 31. A second mount member 136, which carries frangible element 114 can be slid upwardly inside the bore 137 in first member 133. Once the frangible element is positioned in place, thumb screw 138 can be used to lock the two-piece mount 132 together as a unit. Sheath 118 and wires 112 and 113 extending from the mount should be long enough and flexible enough to accommodate rocking of the rocker arm during loading and even when the haul rope derails from the sheaves and is not caught by the rocker arm.

It should be noted that in most rocker arm assemblies there will be a rope derailment responsive device 111 positioned proximate both the lead and trailing sheaves. Thus, when a haul rope derails breaking of the frangible element in either of devices 111 will terminate lift operation.

It is preferable to form rocker arms 23 as cast aluminum members having steel tubular axles 31 cast integrally therewith. Similarly, rocker arm 24 can be cast, and as best may be seen in FIGS. 4, 5 and 6, both rocker arms 23 and 24 can be hollowed out with occasional reinforcing ribs so as to minimize the material in and the weight of the rocker arm castings. As was described in connection with FIGS. 11 and 12, a rod or retention device can be inserted into the hollows of the casting to prevent rotation of rocker arm 24 to an inverted position prior to loading or support of the haul rope on the sheaves.

Figure 6:
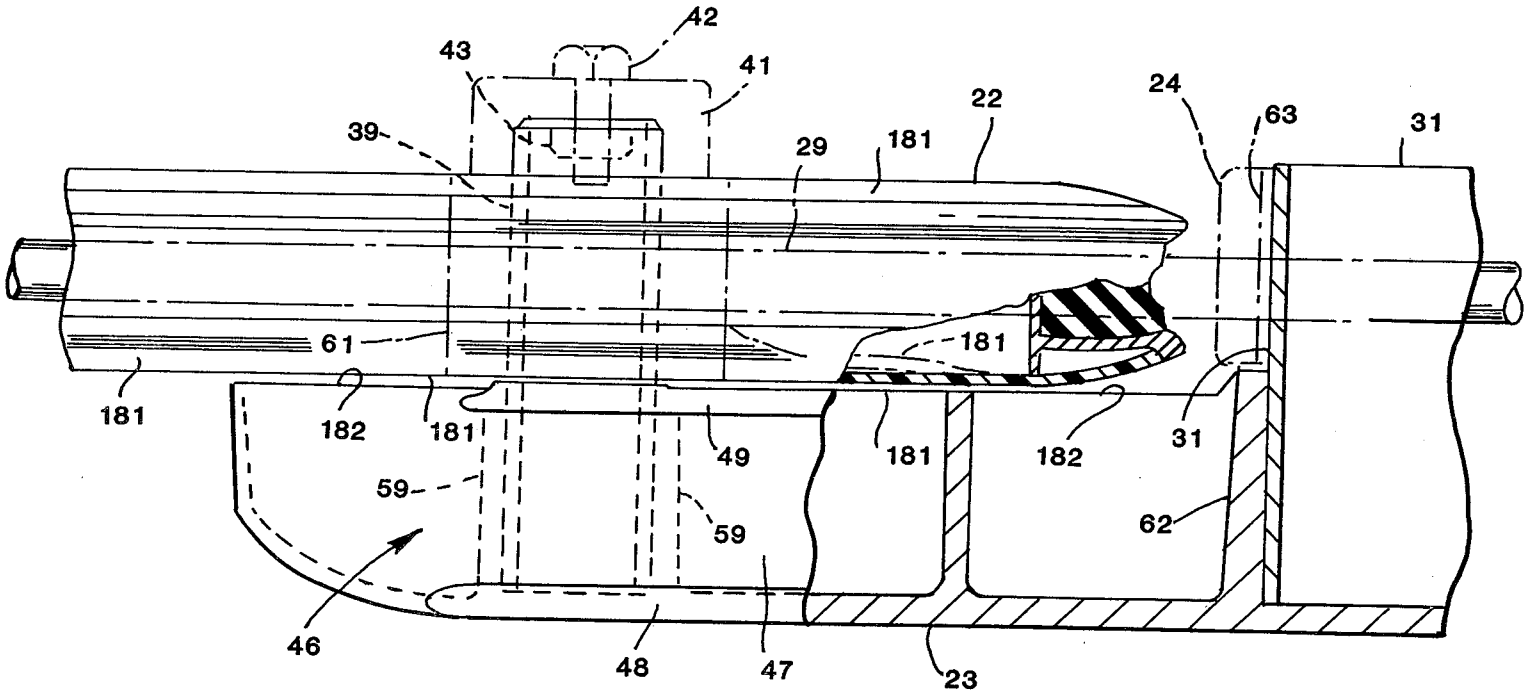
FIG. 6 is an enlarged, fragmentary, top plan view, partially in cross-section, taken substantially along the plane of like 6—6 in FIG. 5.

An additional important feature of the rocker arm assembly of the present invention can best be understood by reference to FIG. 6. In order to minimize any tendency for ice or snow to inhibit or affect rotation of sheaves 22, it is preferable to form sheaves 22 with a flexible non-metallic side panel 181 and to position the inner edge 182 of two-sheave rocker 23 in close proximity to panel 181. Edge 182 of the two-sheave rocker will shear off any snow or ice adhering to the side panels of the sheaves. Flexure of side panels 181, as shown in phantom, will further cause ice spanning between rocker arm 23 and sheave 22 to fall away.

It is preferred to form panels 181 of a relatively ultraviolet radiation insensitive, flexible plastic such as polyethylene with a smooth, low coefficient of friction outer surface. Since rocker arms 23 are preferably cast aluminum, ice and snow do not permanently adhere to the dissimilar materials and will quickly be wiped off the flexible sheave side panel by edge 182. Just as flexure of plastic ice trays releases the ice cubes, flexure of plastic side panels 181 will cause ice to fall away from sheaves 22.

What is claimed is:

1. A rocker arm assembly for support, of a haul rope for an aerial tramway or the like including rocker arm means, rope supporting sheave means rotatably mounted to said rocker arm means, and rocker arm mounting means formed for pivotal cantilevered mounting of said rocker arm means outwardly from a support structure, wherein the improvement in said assembly is comprised of:

said rocker arm means including a sheave carrying rocker arm formed and positioned to extend along only an outward side of said sheave means;

said sheave means being cantilevered inwardly toward said support structure from said sheave carrying rocker arm to position said sheave means for support of said rope inwardly of said sheave carrying rocker arm, and said sheave carrying rocker arm being integrally formed with rope catching means outwardly of said sheave means and being formed for passage of hanger arm means attached to said rope and supported on said rope catching means over the outwardly facing side of said rocker arm means.

2. The rocker arm assembly as defined in claim 1 wherein, said rope catching means is formed as a groove extending parallel to said rope in an upwardly facing side of said sheave carrying rocker arm.

3. The rocker arm assembly as defined in claim 2 wherein, said groove extends over substantially the entire length of said sheave carrying rocker arm; and said sheave carrying rocker arm and said groove are formed for passage of said rope and said hanger arm thereover when said rope is supported in said groove.

4. The rocker arm assembly as defined in claim 1 wherein, said rocker arm means includes two sheave carrying rocker arms each positioned outwardly of said sheave means and a support rocker arm, sheave means rotatably mounted to and cantilevered inwardly from each of said sheave carrying rocker arms and aligned for support of said rope thereon, said sheave carrying rocker arms being pivotally mounted to and outwardly cantilevered from rocker arm mounting means being formed for mounting of said support rocker arm to said support structure, said rope catching means being formed in said sheave carrying rocker arms.

5. The rocker arm assembly as defind in claim 4, and two additional sheave carrying rocker arms, sheave means rotatably mounted to and inwardly cantilevered from each of said additional rocker arms, an additional support rocker arm, said additional sheave rocker arms being outwardly cantilevered from said additional support rocker arm, an assembly rocker arm, said support rocker arm and said additional support rocker arm being pivotally mounted to said assembly rocker arm, said rocker arm mounting means being mounted to said assembly rocker arm and formed for mounting to said support structure, and at least one of said sheave carrying rocker arms and at least one of said additional sheave carrying rocker arms being formed with said rope catching means.

6. The rocker arm assembly as defined in claim 5 wherein, said support rocker arm and said additional support rocker arm are cantilevered outwardly from said assembly rocker arm, and each of said sheave carrying rocker arms and said additional sheave carrying rocker arms is formed with said rope catching means.

7. The rocker arm assembly as defined in claim 6 wherein, said rope catching means is formed as recesses extending over substantially the entire length of the upwardly facing sides of said sheave carrying rocker arms and said additional sheave carrying rocker arms, and said recesses are substantially aligned over the length of said assembly.

8. The rocker arm assembly as defined in claim 1 or claim 2 wherein, each sheave in said sheave means is removably mounted to the rocker arm on which it is cantilevered and rotatably mounted and is formed for removal therefrom without the need for removal of said rocker arm from said assembly.

9. The rocker arm assembly as defined in claim 1 wherein, said sheave means is formed with a flexible side panel on a side panel on a side thereof closest to said rocker arm means, and said rocker arm means includes a edge extending radially along said sheave means in close proximity thereto to wipe ice and snow from said sheave means.

10. The rocker arm means as defined in claim 9 wherein, said side panel is formed of a flexible plastic material.

11. A rocker arm assembly for support of a haul rope for an aerial tramway or the like including elongated rocker arm means, sheave means rotatably mounted to said rocker arm means, and rocker arm mounting means formed for mounting of said rocker arm means to a support structure, wherein the improvement in said assembly is comprised of:

said rocker arm means being formed with substantially the entire mass of said rocker arm means positioned on an outer side of said sheave means for support of said sheave means cantilevered inwardly from said outer side;

said rocker arm means being formed with an elongated rope catching recess means in an upwardly facing surface thereof, said recess means extending in said rocker arm means proximate said sheave means.

12. The rocker arm assembly as defined in claim 11 wherein, said recess means is formed as a substantially continuous groove in said upwardly facing surface of said rocker arm means, and said groove extends over substantially the entire length of said rocker arm means.

13. A rocker arm assembly for support of a haul rope for an aerial tramway or the like including a pair of sheave carrying rocker arms, at least one sheave rotatably mounted to each of said sheave carrying rocker arms, a support rocker arm, first mounting means pivotally mounting said sheave carrying rocker arm means to said support rocker arm, and second mounting means formed for pivotal cantilevered mounting of said support rocker arm outwardly from an assembly support structure, wherein the improvement in said rocker arm assembly is comprised of:

said first mounting means being formed to cantilever each of said sheave carrying rocker arms outwardly from said support rocker arm, said sheave carrying rocker arms extending along only an outward side of said sheaves, and the sheaves each being cantilevered inwardly from said sheave carrying rocker arms and rope catcher means formed as recess means in an upwardly facing surface of each of said sheave carrying rocker arms and extending substantially over the length of the sheave carrying rocker arms and parallel to said rope as supported on said sheaves.

* * * * *

UNITED STATES PATENT AND TRADEMARK OFFICE

CERTIFICATE OF CORRECTION

PATENT NO. : 4,462,314

DATED : July 31, 1984

INVENTOR(S) : Jan K. Kunczynski

It is certified that error appears in the above-identified patent and that said Letters Patent are hereby corrected as shown below:

Col. 11, line 42, delete "43" and insert ---143---;

Col. 13, line 30, delete "terminte" and insert ---terminate---;

Col. 13, line 42, delete "biasingby" and insert ---biasing by---;

Signed and Sealed this

*Twenty-sixth* Day of *February 1985*

[SEAL]

*Attest:*

DONALD J. QUIGG

*Attesting Officer* *Acting Commissioner of Patents and Trademarks*